US005628603A

United States Patent [19]

Antalffy et al.

[11] Patent Number: 5,628,603

[45] Date of Patent: May 13, 1997

[54] AUTOMATED CHUTE SYSTEM

[75] Inventors: Leslie P. Antalffy, Houston; Robert Benoit, Richmond; Michael B. Knowles; David W. Malek, both of Houston; Samuel A. Martin, Sugarland, all of Tex.

[73] Assignee: Fluor Corporation, Irvine, Calif.

[21] Appl. No.: 347,646

[22] Filed: Nov. 30, 1994

[51] Int. Cl.[6] ..... C10B 33/14

[52] U.S. Cl. ..... 414/216; 193/30; 202/262; 414/786

[58] Field of Search ..... 414/210, 216, 414/786; 201/41; 202/262; 422/232; 193/6, 30

[56] References Cited

U.S. PATENT DOCUMENTS

| | | | |
|---|---|---|---|
| 3,576,263 | 4/1971 | Abendroth | 193/30 X |
| 3,799,367 | 3/1974 | Grewer et al. | 414/210 |
| 3,985,245 | 10/1976 | Schulte | 193/30 X |
| 4,066,175 | 1/1978 | Schulte | 193/30 X |
| 4,189,272 | 2/1980 | Gregor et al. | 202/262 X |
| 4,314,787 | 2/1982 | Kwasnik et al. | 193/30 X |
| 4,822,229 | 4/1989 | Legille et al. | 414/216 X |
| 4,988,411 | 1/1991 | Schroter | 202/262 X |
| 5,016,686 | 5/1991 | Gerstenkorn | 193/30 X |
| 5,145,271 | 9/1992 | Binzen | 193/30 |
| 5,384,015 | 1/1995 | Schroter et al. | 202/262 X |

*Primary Examiner*—David A. Bucci
*Attorney, Agent, or Firm*—Crockett & Fish

[57] ABSTRACT

The inlet of a coke chute is pushed upwards by a plurality of actuators until it encompasses the bottom outlet of a coking vessel. The inlet is preferably surrounded by a skirt which tapers inwardly from top to bottom, and the entire chute is preferably retractable below the level of the floor underneath the coking vessel. A plurality of locks can be used to secure the skirt to the lower portion of the vessel.

14 Claims, 3 Drawing Sheets

AUTOMATED CHUTE SYSTEM

BACKGROUND OF THE INVENTION

The present invention relates to the field of hydrocarbon processing.

Many refineries recover valuable products from the heavy residual oil that remains after refining operations are completed. This recovery process, known as delayed coking, produces valuable distillates and coke in one or more large vessels known as coke drums or coking vessels. As used herein, coking drums and vessels are used interchangeably.

Coke drums are typically large, cylindrical vessels having a top head and a frusto-conical bottom portion fitted with a bottom head. Coke drums are usually present in pairs so that they can be operated alternately. Thus, while one coke drum is being filled with residual oil and heated, the other drum is being cooled and purged of up to several hundred tons of coke formed during the previous recovery cycle. The operating conditions of delayed coking can be quite severe. Normal operating pressure typically range from 40 to about 60 pounds per square inch, and the feed input temperature may be over 900° F.

Coke recovery begins with a water quench step in which steam and water are introduced into the coke filled vessel to complete the recovery of volatiles and to cool the mass of coke. The vessel is then vented to atmospheric pressure and the top head (typically a 4-foot diameter flange) is unbolted and removed. A hydraulic coke cutting apparatus is inserted into the vessel to cut the coke, and finally, the bottom head (typically a 7-foot diameter flange) is unbolted and removed to allow the hydraulically cut coke to fall out of the vessel and into a recovery chute. While ideally all of the coke is captured by the chute and falls through to a coke pit below, in practice there is spillage, and essentially all of the coke is taken to be channeled through to the coke pit as long as no more than a few percent of coke spills onto the floor.

Due to the size of the drum bottom outlet, the large mass of coke and water which falls through the outlet, and the need to position the drum bottom outlet away from the floor so that the drum bottom head can be removed, positioning the recovery chute with respect to the coke drum bottom outlet can be difficult. In a typical installation, the coke chute is located in a channel between the switch-deck floor and a coke pit below. Once the coke drum head is removed, or at least pivoted or otherwise moved out of the way of the drum outlet, chain hoists are attached to the circumference of the chute, and the chute is manually raised to mate with the coke drum bottom flange. This process may be dangerous in that operators involved with raising of the chute may be injured during a coke cave-in within the drum.

One possible solution, described in U.S. Pat. No. 4,960,358 to DiGiacomo, issued Oct. 2, 1990, is to suspend the chute from the drum using hydraulic cylinders, and then to use the hydraulic cylinders to raise and lower the chute. While this serves to automate movement of the chute, it is still unsatisfactory in that the cylinders are positioned above the floor where they can interfere with the deheading process by impeding access to the coke drum flange. Other difficulties may also exist, in that the DiGiacomo device still requires insertion of a gasket between the chute to the bottom flange, and the device forms part of an integrated deheading frame device, which may render it inapplicable to installations using alternative deheading systems.

Thus, there is a further need for an improved method and system of positioning a coke chute with respect to the bottom opening of a coke drum. Other and further objects and advantages will appear hereinafter.

SUMMARY OF THE INVENTION

To these ends, a coke chute has an upper portion dimensioned to circumferentially encompass the outlet of a coking vessel. The upper portion is preferably in a collapsible relationship with the remainder of the chute, and is raised and lowered from below using a plurality of actuators.

BRIEF DESCRIPTION OF THE DRAWING

In the drawings, wherein similar reference characters denote similar elements throughout the several views.

DETAILED DESCRIPTION OF THE DRAWINGS

Figure 1:
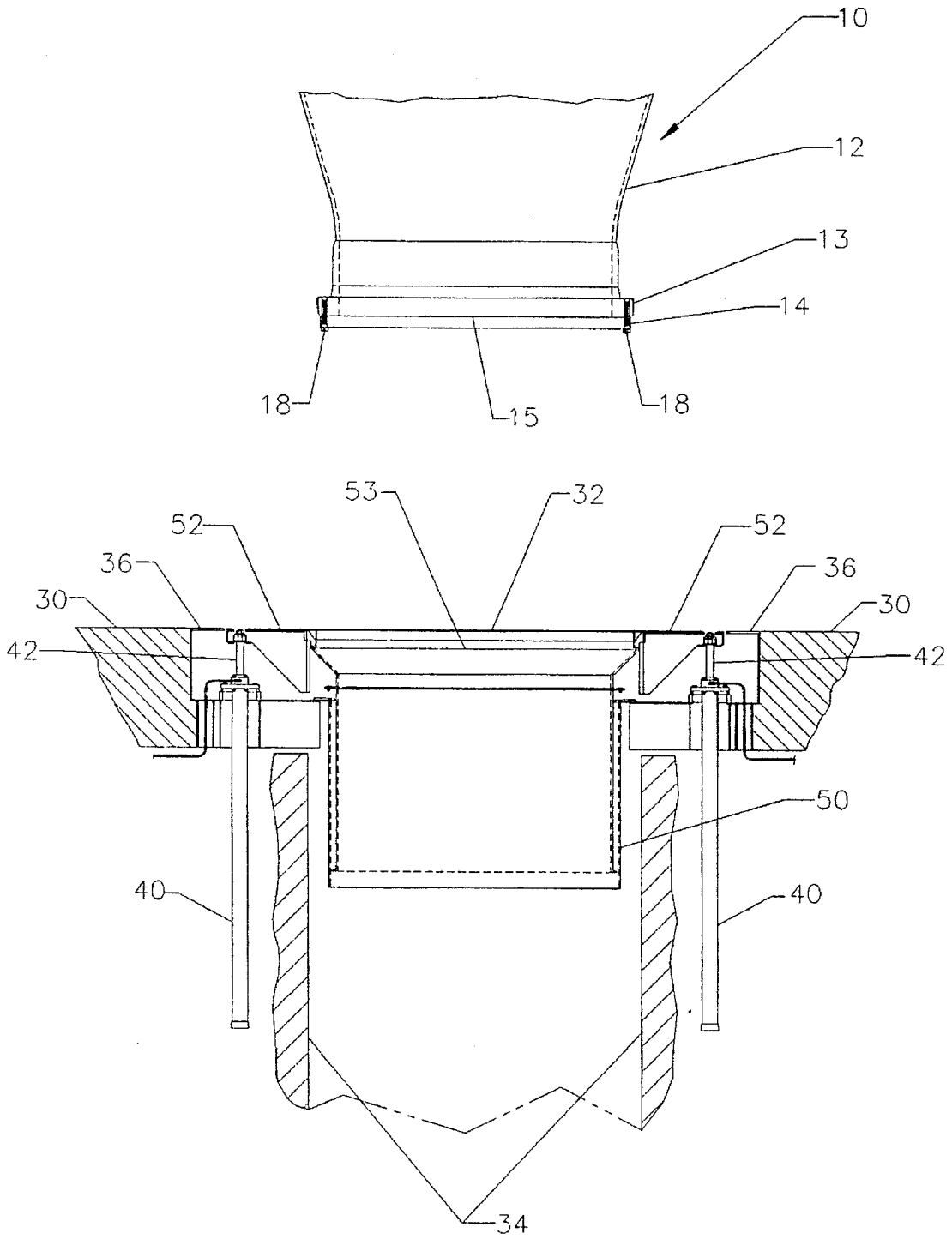
FIG. 1 is a vertical side view of a chute and bottom portion of a coke drum with the chute lowered.

In the upper portion of FIG. 1, a delay coking vessel 10 is shown in the closed position. The vessel 10 has a generally frusto-conical bottom portion 12 which terminates in a bottom outlet 15 surrounded by an outlet flange 13. A bottom head 14 is bolted to the flange 13 with bolts 18 to prevent whatever contents are within the vessel 10 from falling out through outlet 15.

In the lower portion of FIG. 1, a switch deck floor 30 lies generally under the coke vessel 10. A removable deck cover plate 32 lies directly under the bottom outlet 15, and below the cover plate 32 lies a channel 34 through which coke from the coking vessel 10 can pass to reach the coke pit (not shown). At the upper portion of channel 34 is a telescoping chute 50 to which is attached a skirt 52. The upper circumference of the skirt 52 defines the inlet 53 to the chute 50. Also at the upper portion of channel 34 is a concrete or structural steel lining 36 into which are set three or four hydraulic cylinders 40. Each hydraulic cylinder 40 contains a rod 42 which is attached to the skirt 52 in such a manner that the chute can be extended or recessed by moving the skirt 52 up and down.

Figure 2:
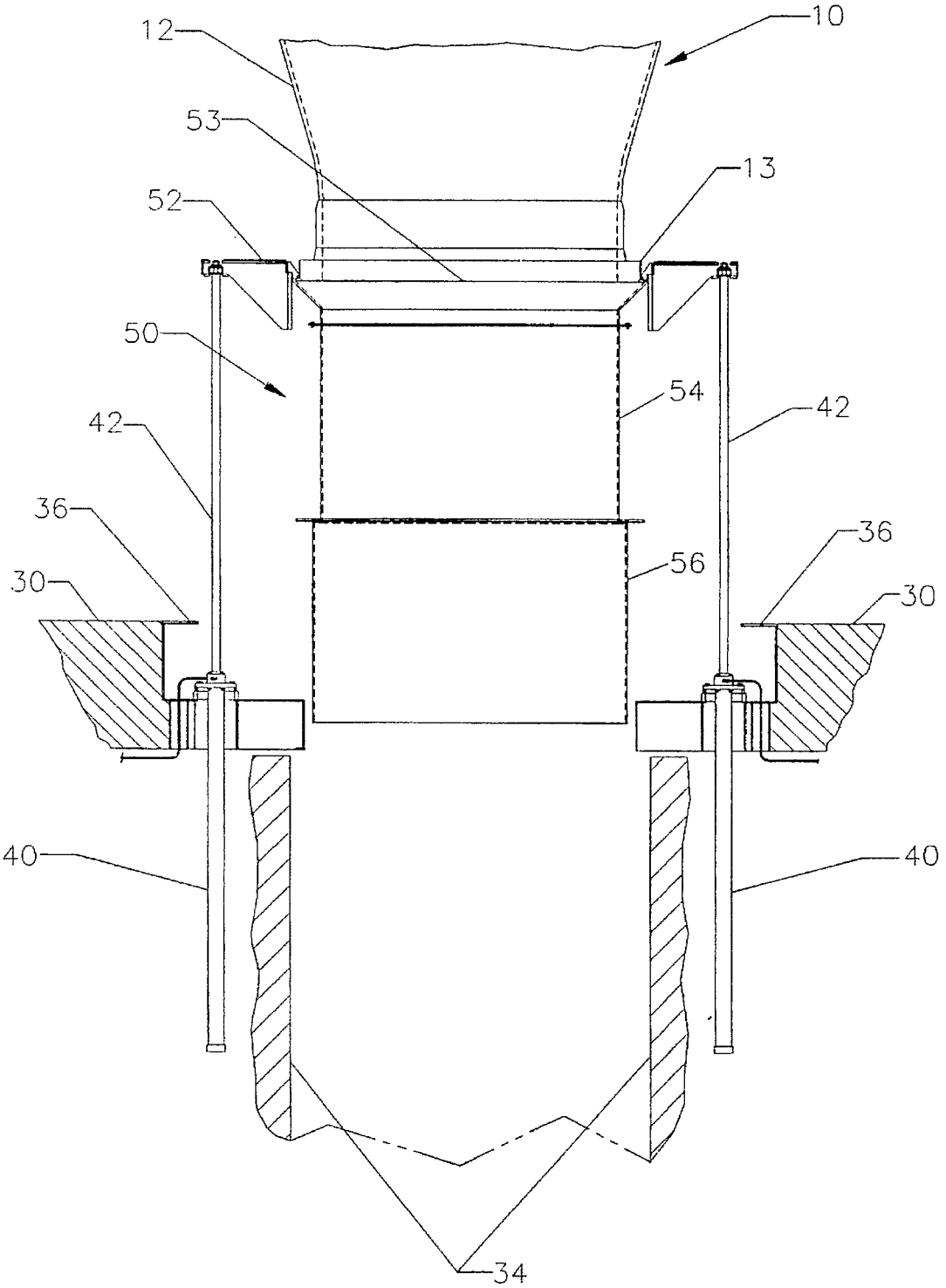
FIG. 2 is a vertical side view of a chute and bottom portion of a coke drum with the chute raised.

In FIG. 2 the coking vessel 10 is shown in an open position. The bottom head 14 has been removed and is not shown in the Figure. The cylinder rods 42 extend out of the cylinders 40 to a sufficient length that the skirt 52 circumferentially encompass the outlet flange 13. The chute 50 has also been extended, thereby telescoping sections 54 and 56. In this position coke and water from the coking vessel 10 can fall through the chute 50, through channel 34 and into the coke pit (not shown).

Figure 3:
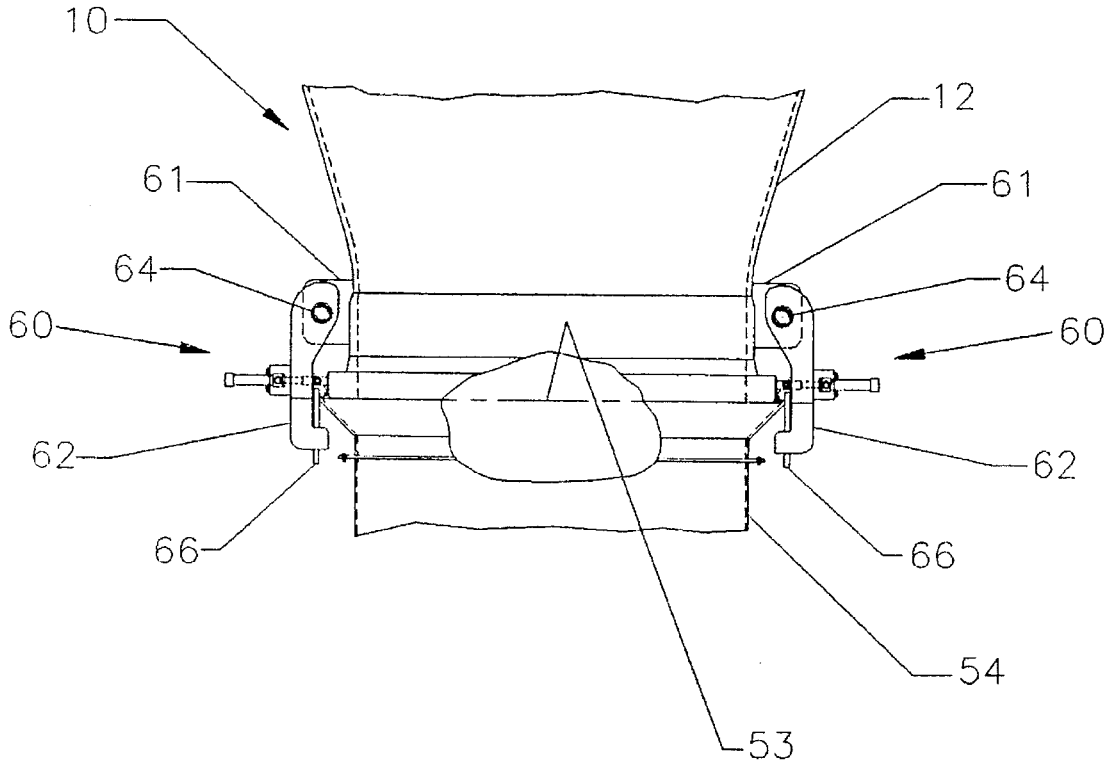
FIG. 3 is another vertical side view of a chute and bottom portion showing two locking mechanisms.

In FIG. 3 the skirt 52 may be locked in place on the bottom portion 12 of vessel 10 using a plurality of optional locks 60. Each of the locks 60 has a connecting plate 61 affixed to the bottom portion 12 of vessel 10, a latch 62, and a pivot 64 about which the latch 62 can pivot. The bottom end of latch 62 cooperates with either a notch or knob 66, thereby locking the skirt 52 to the vessel 10.

The device and methods disclosed with respect to FIGS. 1–3 are advantageous in many ways over that previously known in the art. One advantage is that the automation of the chute need not be dependent upon any particular deheading device. This permits the device and method described herein to be used in cooperation with deheading devices that completely remove the head from the coking vessel, as well as deheading devices in which the head pivots away from the vessel outlet. It also permits the present device and method to retrofit existing coking operations without necessarily retrofitting the deheading apparatus. Other advantages result from the hydraulic cylinders or other actuators operating from underneath the chute. One such advantage is that the cylinders do not interfere in the deheading operation. Another advantage is that in the event of a coke cave-in during the deheading process, the cylinders, frame device, or other apparatus operating the chute, will not be buried by the coke. Still another advantage is that by using a skirt which flanks the bottom outlet and outlet flange as opposed to mating with the outlet flange, a coke cave-in which occurs during the raising of the chute will likely be contained within the chute, and will not hamper the raising process. The optional locks are also advantageous in that they provide additional assurance to the operators that the chute will remain in the extended position even if one or more of the hydraulic cylinders fails.

There are numerous alternative embodiments which fall within the spirit and scope of the claimed invention. With respect to the vessel, the bottom outlet need not be located at the very bottom of the vessel, and need not even lie in a horizontal position. Thus, the bottom outlet as used herein includes outlets positioned at any point within the tapered lower portion of a coking vessel. Additionally, the coking vessel, outlet, outlet flange and chute are all depicted as having a circular horizontal side view. Other cross-sections are also possible, and the cross-section of the skirt or chute need not necessarily match the cross-section of the vessel, outlet, or outlet flange. Thus, the term, circumferentially encompass, and related terms include, but are not limited to circular circumferences.

With respect to the actuators, the hydraulic cylinders and rods shown in the drawings can be replaced by worm gears or other types of actuators, and two, three, four or more actuators may be used.

With respect to the chute, the skirt may be extended further above or below the outlet flange than shown in FIGS. 2 and 3, and need not fit so closely as shown. Similarly, when the chute is fully recessed, the deck cover plate need not be flush with the switch deck floor. The chute is depicted in the drawings as being composed of two telescoping sections, but a greater or lesser number of sections may be used, and the chute may even bend in the manner of a flexible exhaust pipe of a household clothes dryer. Moreover, the chute need not telescope at all, and may instead be entirely recessed into the channel leading to the coke pit. The terms collapsible, retractable and extensible are used herein to encompass all of these possibilities.

The locks, as noted above, are optional, and in other embodiments other types of locks may be employed, as for example pins set into the hydraulic rods.

Thus, a method and device for positioning a coke chute with respect to the bottom opening of a coke drum has been disclosed. While specific embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. An apparatus for channeling the flow of coke from a bottom outlet of a coking vessel, comprising:

a coke chute having an upper portion sized and dimensioned to circumferentially encompass the bottom outlet of the vessel; and a plurality of actuators positioned to push the upper portion of the chute into a proximate relationship with the bottom outlet such that essentially all of the coke flowing through the bottom outlet is channeled through the chute.

2. The apparatus of claim 1 wherein the chute is retractable between an extended position and a retracted position.

3. The apparatus of claim 2 wherein the upper portion of the chute comprises a skirt tapered inwardly from top to bottom.

4. The apparatus of claim 3 wherein at least one of the actuators comprises a hydraulic cylinder and rod.

5. The apparatus of claim 4 further comprising a plurality of locks capable of maintaining the extended position of the chute upon failure of at least one of the actuators.

6. The apparatus of claim 4 further comprising a plurality of locks capable of releasably coupling the skirt to the vessel when the chute is in the extended position.

7. An improved delayed coking system having a coking vessel with a bottom outlet and a coke chute with an upper inlet, the improvement comprising:

the inlet sized larger than the outlet;

the chute collapsible between an extended position and a retracted position; and at least one actuator positioned to push up a portion of the chute such that the inlet encompasses the outlet.

8. The system of claim 7 wherein the vessel is located above a floor, and the chute can be retracted entirely below the highest point of the floor under the vessel.

9. The system of claim 8 wherein the upper portion of the chute comprises a skirt tapered inwardly from top to bottom.

10. The system of claim 9 wherein at least one of the actuators comprises a hydraulic cylinder and rod.

11. The system of claim 10 further comprising a plurality of locks capable of maintaining the extended position of the chute upon failure of at least one of the actuators.

12. The system of claim 10 further comprising a plurality of locks capable of releasably coupling the skirt to the vessel when the chute is in the extended position.

13. A method of directing coke from an outlet of a vessel to a coke pit comprising:

providing an extensible coke chute having an inlet and a passageway to the coke pit;

providing at least one actuator coupled to the coke chute;

actuating the actuator to push the inlet up to and around the outlet; and allowing the coke to flow through the chute.

14. The method of claim 13 wherein the vessel is located above a floor, and the chute can be retracted entirely below the highest point of the floor under the vessel, the upper portion of the chute comprises a skirt tapered inwardly from top to bottom, at least one of the actuators comprises a hydraulic cylinder and rod, and further comprising a plurality of locks capable of maintaining the extended position of the chute upon failure of at least one of the actuators.

* * * * *